US009550203B2

(12) United States Patent
Hwang et al.

(10) Patent No.: US 9,550,203 B2
(45) Date of Patent: Jan. 24, 2017

(54) MARKING SYSTEM FOR SPRINGS

(71) Applicant: Sammok Kangup Co., Ltd., Ansan (KR)

(72) Inventors: dong hyun Hwang, Ansan (KR); jae yeol Han, Ansan (KR)

(73) Assignee: YOUNGHEUNG IRON & STEEL CO. LTD., Boryeong-si (KR)

( * ) Notice: Subject to any disclaimer, the term of this patent is extended or adjusted under 35 U.S.C. 154(b) by 103 days.

(21) Appl. No.: 14/627,295

(22) Filed: Feb. 20, 2015

(65) Prior Publication Data

US 2015/0238996 A1 Aug. 27, 2015

(30) Foreign Application Priority Data

Feb. 25, 2014 (KR) ..... 10-2014-0021668

(51) Int. Cl.

| | |
|---|---|
| ***B05C 1/02*** | (2006.01) |
| ***B05C 11/02*** | (2006.01) |
| ***B05C 13/02*** | (2006.01) |
| ***B41F 17/00*** | (2006.01) |
| ***B41F 17/20*** | (2006.01) |
| *B05C 1/06* | (2006.01) |

(52) U.S. Cl.

CPC ..... *B05C 1/02* (2013.01); *B05C 11/023* (2013.01); *B05C 13/02* (2013.01); *B41F 17/001* (2013.01); *B41F 17/002* (2013.01); *B41F 17/006* (2013.01); *B41F 17/20* (2013.01); *B05C 1/022* (2013.01); *B05C 1/027* (2013.01); *B05C 1/06* (2013.01)

(58) Field of Classification Search

CPC ..... B41F 17/20; B41F 17/001; B41F 17/30; B41F 17/006; B41F 17/002; B41F 17/28; B05C 1/02; B05C 11/023; B05C 13/02; B05C 13/025; B05C 1/022; B05C 1/027; B05C 1/06

USPC ..... 101/333, 35, 39, 44; 118/264, 269, 270, 118/DIG. 3, 500; 427/2.1, 2.24, 428.01

See application file for complete search history.

(56) References Cited

U.S. PATENT DOCUMENTS 5,694,839 A * 12/1997 Wohl ..... B41F 17/001 101/39
6,276,266 B1 * 8/2001 Dietz ..... B41F 17/001 101/41

FOREIGN PATENT DOCUMENTS

KR 2007006629 A * 1/2007

* cited by examiner

*Primary Examiner* — Laura Edwards
(74) *Attorney, Agent, or Firm* — Cantor Colburn LLP

(57) ABSTRACT

A marking system for springs comprises: an arranging apparatus for arranging a spring; and a marking apparatus for applying an identification mark on the spring. The marking apparatus comprises: a frame having a space for marking therein; a pad unit for applying a mark on the spring located in the frame; and an ink unit for supplying ink to the pad unit.

5 Claims, 14 Drawing Sheets

MARKING SYSTEM FOR SPRINGS

BACKGROUND OF THE INVENTION

1. Field of the Invention

The present invention related to a marking system for springs, and more particularly to a marking system for springs which applies a mark on a left surface of a spring using ink for identifying springs according to characteristics thereof after various tests are performed.

2. Description of the Prior Art

In general, a completely manufacturing spring undergoes several tests for identifying whether it is manufactured to have characteristics suitable for a design value.

It is classify springs through marking to indicate load characteristics of the springs, and marking also may be used to sort defective products. A marking process for classifying the characteristic of product is one of processes essentially required to increase reliability of products.

A marking inspection is performed to identify whether the marking is properly performed after the marking is performed, and the springs should be marked with clear shapes and colors such that the marks of the springs can be easily identified by automation equipment for an automatic marking inspection.

To achieve this, a method of applying a mark by manually bringing a pad to which ink is stuck into contact with a spring by an operator has been generally bused, but because an operation of marking a spring is time-consuming as a time for sticking ink to a pad is added to a delay time due to a manual operation, productivity of the spring deteriorates.

Although a time for sticking marking ink to a pad is shortened when a marking operation is performed using a spray to improve the problem, a periphery of the marking shape is spread out and the marking shape does not clearly appear, and a location of the mark may be distorted, so that because automation equipment may not recognize a marks during an automated marking inspection, time may be delayed in the marking inspection process.

SUMMARY OF THE INVENTION

An objective of the present invention is to shorten time through an automated process when a marking operation is performed on a side surface of a spring such that characteristics, such as strength and polarity, of a manufactured spring are identified, and to form a clearer marking shape by performing a marking operation in a method of bringing ink and a pad into direct contact with the spring.

In accordance with an aspect of the present invention, there is provided a marking system for springs including: an arranging apparatus for arranging a spring; and a marking apparatus for applying an identification mark on the spring.

The marking apparatus includes: a frame having a space for marking therein; a pad unit for applying a mark on the spring located in the frame; and an ink unit for supplying ink to the pad unit, and the pad unit includes: a pad for applying a mark on the spring; a pad feeding unit to which the pad is connected, for moving the pad upwards and downwards, and forwards and rearwards; a pad unit cylinder to which the pad is connected, for providing power for moving the pad upwards and downwards; and a rodless cylinder connected to the pad feeding unit, for providing power for moving the pad forwards and rearwards.

The ink unit includes: an ink cup base; an ink cup for supplying ink; a marking plate to which the ink contained in the ink cup is stuck; a marking plate feeding unit for positioning the marking plate and moving the marking plate forwards and rearwards on a lower side of the ink cup; and a marking unit cylinder for providing power for moving the marking plate feeding unit forwards and rearwards.

The arranging apparatus includes: an arranging unit base; a first arranging jig fixed to the arranging unit base to contact one surface of the spring; a second arranging jig located at a site facing the first fixing jig and contacting an surface opposite to the surface of the spring that contacts the first arranging jig; a rotary motor connected to the second arranging jig, for rotating the second arranging jig; an arranging unit moving unit to which the second arranging jig is fixed and configured to move forwards and rearwards towards the spring; an arranging unit moving shaft passing through the arranging unit moving unit; and an arranging unit cylinder connected to the arranging unit moving unit, for moving the arranging unit moving unit forwards and rearwards.

An escape part contacting an end of the spring where the rotation of the spring is completely ended is formed in the second arranging jig, and the spring is rotated by bringing the escape part and the end of the spring into contact with each other through rotation of the second arranging jig, and a protrusion contacting a start part of the spring where the spring starts to be rotated is formed in the first arranging jig, and a location of the spring is arranged by bringing the protrusion and the start part of the spring into contact with each other through rotation of the spring.

According to the present invention, because a marking operation is performed on a spring positioned in a jig using a marking pad that moves forwards and rearwards, and upwards and downwards, productivity increases as compared with a manual operation, and because a marking pad to which ink is stuck is brought into direction contact with a spring, a clear mark is applied at a predetermined location of the spring.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, an embodiment of the present invention will be described in detail with reference to the accompanying drawings.

Figure 1:
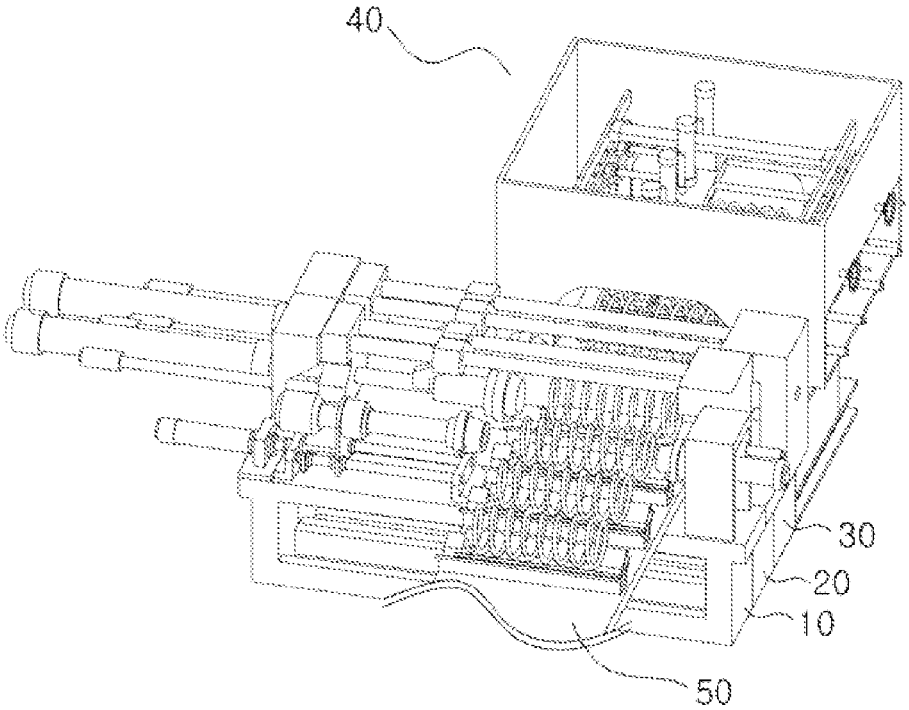
FIG. 1 is a perspective view illustrating a marking system for springs according to an embodiment of the present invention.
Figure 2:
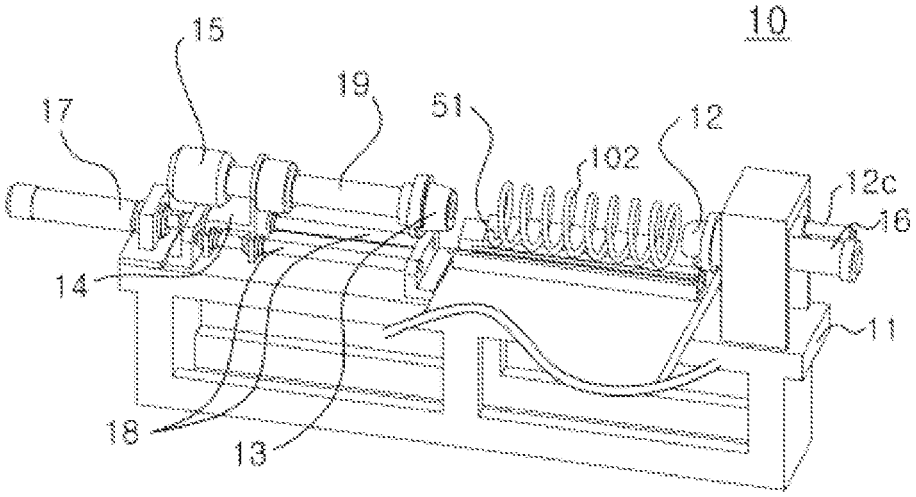
FIG. 2 is a perspective view illustrating an arranging unit of a marking system for springs according to an embodiment of the present invention.
Figure 3:
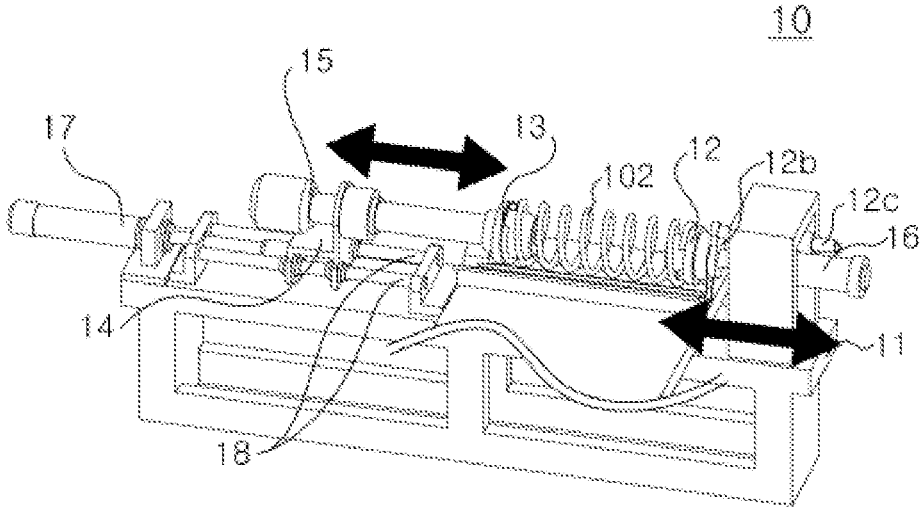
FIG. 3 is a perspective view illustrating driving of an arranging unit driving unit in an arranging unit of a marking system for springs according to an embodiment of the present invention.
Figure 4:
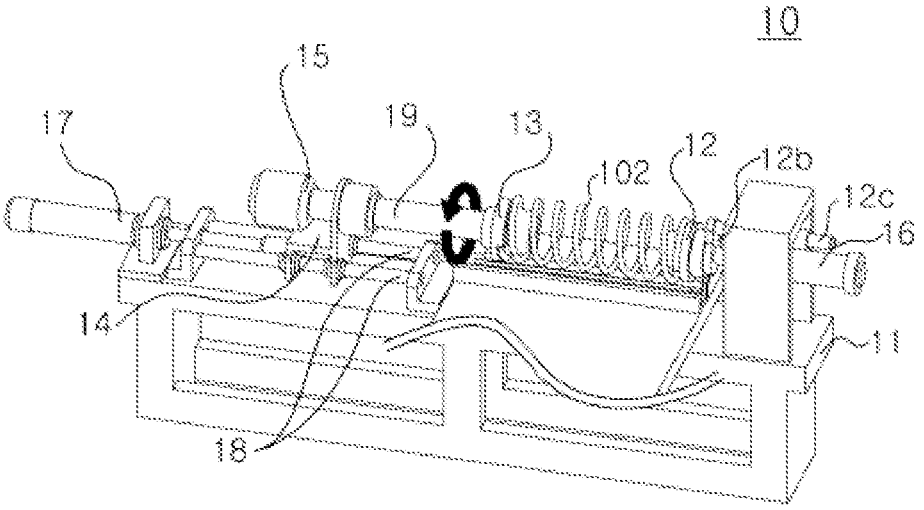
FIG. 4 is a perspective view illustrating rotation of a second arranging jig in an arranging unit of a marking system for springs according to an embodiment of the present invention.
Figure 5:
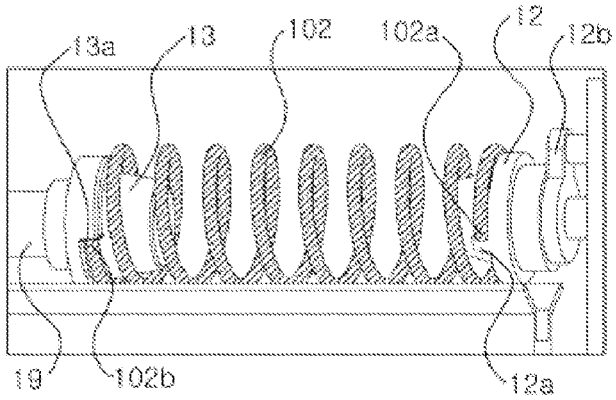
FIG. 5 is a perspective view illustrating an arranging jig and a spring in an arranging unit of a marking system for springs according to an embodiment of the present invention.

Referring to FIG. 1, a marking system for springs according to the present invention includes an arranging apparatus 10 for arranging a spring, a setting apparatus 20 for reducing permanent deformation of the spring 102, an inspection apparatus 30 for measuring a load of the spring 102, a marking apparatus 40 performing a marking operation on a side surface of the spring 102 for classification according to the load of the spring 102, a conveyor 40 for feeding the spring 102, and a controller (not illustrated).

Referring to FIGS. 2 to 5, the arranging apparatus 10 serves to arrange springs such that the locations and directions of all the springs 102 are the same. The arranging apparatus 10 includes an arranging unit base 11, a first arranging jig 12 fixed to the base 11 and adhered to one surface of the spring 102, a fixing member 12*b* connected to the first arranging jig 12, for fixing the first arranging jig 12 such that the first arranging jig 12 is not rotated, a fixing shaft 12*c* connected to the fixing member 12*b* and passing through the arranging unit base 11, and a first arranging cylinder 16 connected to the first arranging jig 12, for moving the first arranging jig 12 forwards and rearwards. The arranging apparatus 10 further includes a second arranging jig 13 located to face the first arranging jig 12 and configured to contact a surface opposite to the surface of the spring 102 contacting the first arranging jig 12, a second arranging jig connecting rod 19 connected to the second arranging jig 13, an arranging unit driving unit 14 to which the second arranging jig connecting rod 19 is fixed and configured to move forwards and rearwards towards the spring 102, an arranging unit driving shaft 18 fixed to the arranging unit base 11 and acting as a shaft while passing through the arranging unit driving unit 14, a rotary motor connected to the second arranging jig connecting rod 19, for rotating the second arranging jig 13, and a second arranging cylinder 17 connected to the arranging unit driving unit 14, for moving the arranging unit driving unit 14 forwards and rearwards. A protrusion 12*a* contacting a start part 102*a* of the spring 102 is formed in the first arranging jig 12, and an escape part 13*a* contacting an end 102*b* of the spring 102 is formed in the second arranging jig 13.

A sequence of the operations of the arranging apparatus 10 according to an embodiment of the present invention is as follows. If the spring 102 is located in the arranging apparatus 10 by the conveyor 40, the first arranging jig 12 is moved towards the spring 102 by a preset distance and the second arranging jig 13 is rotated at the same time, and the arranging unit driving unit 14 is moved toward the spring 102 by a preset distance to adhere the first arranging jig 12 and the second arranging jig 13 to opposite surfaces of the spring 102. A second escape part 13*a* of the second arranging jig 13 is brought into an end 102*b* of the spring 102 through rotation of the second arranging jig 13 such that the spring 102 and the second arranging jig 13 are rotated together, and the rotation is stopped if the protrusion 12*a* of the first arranging jig 12 contacts the start part 102*a* of the spring 102. Then, the second arranging jig 13 is rotated in the same direction as that of the rotational direction of the spring 102, and the spring 102 is arranged according to a location of the protrusion 12*a* of the first arranging jig 12. If having been completely arranged, the spring 102 is moved to the setting apparatus 20 using the conveyor 40.

Figure 6:
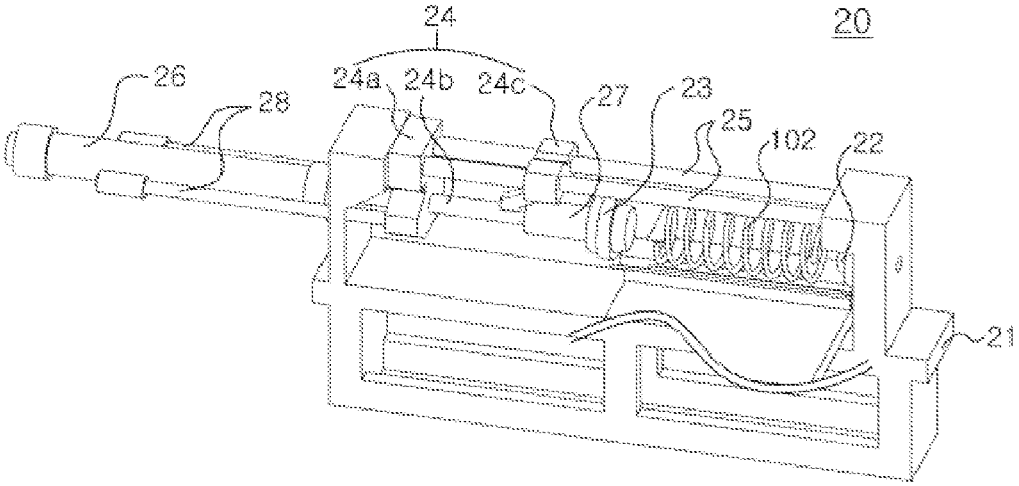
FIG. 6 is a perspective view illustrating a setting unit of a marking system for springs according to an embodiment of the present invention.
Figure 7:
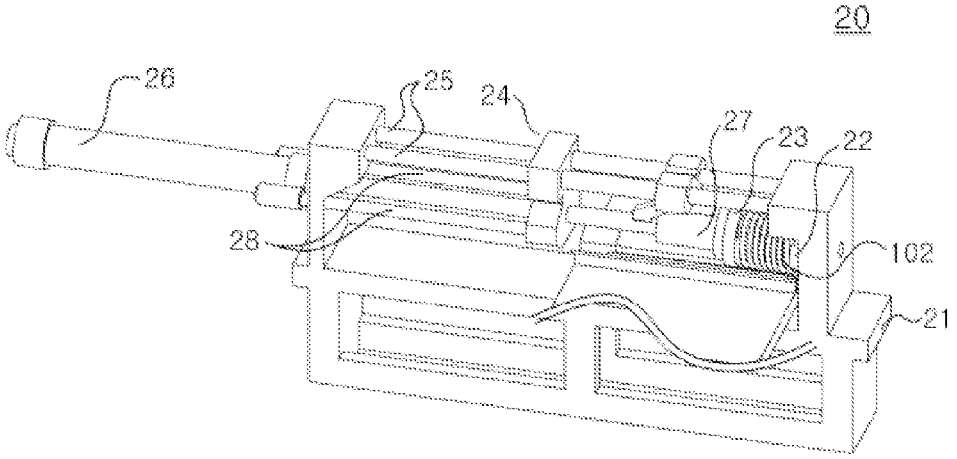
FIG. 7 is a perspective view illustrating driving of a setting unit driving unit in a setting unit of a marking system for springs according to an embodiment of the present invention.

The setting apparatus 20 performs an operation of applying a load exceeding a resiliency limit of the spring 102 to the spring 102 to increase the resiliency limit, and this operation corresponds to an operation for reducing permanent deformation of the spring 102. Referring to FIGS. 6 and 7, the setting apparatus 20 includes a setting unit base 21, a first setting jig 22 connected to the setting unit base 21 and adhered to one surface of the spring 102, a second setting jig 23 located at a site facing the first setting jig 22 and adhered to a surface opposite to the surface of the spring 102 adhered to the first setting jig 22, a second setting jig connecting rod 27 to which the second setting jig 23 is fixed, a setting unit driving unit 24 to which the second setting jig connecting rod 27 is fixed, for moving the second setting jig 23 forwards and rearwards, a setting unit driving shaft 25 installed in the setting unit base 21, for acting as a shaft while passing through the setting unit driving unit 24, a setting unit cylinder 26 for moving the setting unit driving unit 24 forwards and rearwards, and an auxiliary setting unit driving shaft 28 located on a side surface of the setting unit cylinder 26 and fixed to the setting unit driving unit 24 to pass through the setting unit base 21. The setting unit driving unit 24 includes a first setting unit driving member 24*a* in which the setting unit cylinder 26 and the auxiliary setting unit driving shaft 28 are connected on a rear surface thereof and through which the setting unit driving shaft 25 passes, a setting unit driving member connecting rod 24*b* connected to a front surface of the first setting unit driving member 24*a*, and a second setting unit driving member 24*c* connected to the setting unit driving member connecting rod 24*b* and through which the setting unit driving shaft 25 passes.

A sequence of the operations of the setting apparatus 20 according to an embodiment of the present invention is as follows. If the completely arranged spring is moved to the setting apparatus 20 by the conveyor 40, the setting unit driving unit 24 is moved towards the spring 102 by a preset distance such that the spring 102 exceeds a resiliency limit such that the spring 102 is compressed to the first setting jig 22 and the second setting jig 23, and as a result, the spring 102 exceeds the resiliency limit. After the spring 102 is compressed, the setting unit driving unit 24 is moved in a direction away from the spring 102, and the spring 102 is moved to the inspection unit 30 using the conveyor 40.

Figure 8:
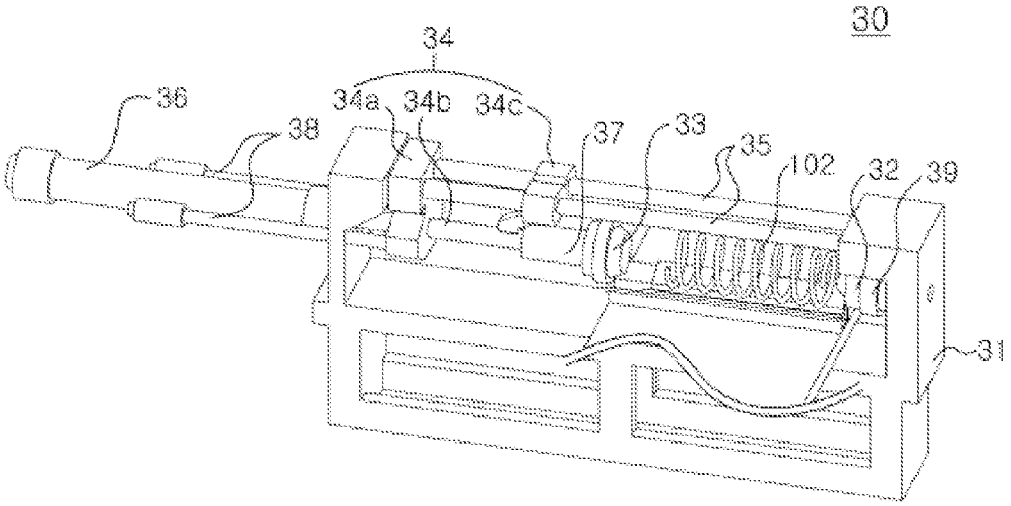
FIG. 8 is a perspective view illustrating an inspection unit of a marking system for springs according to an embodiment of the present invention.
Figure 9:
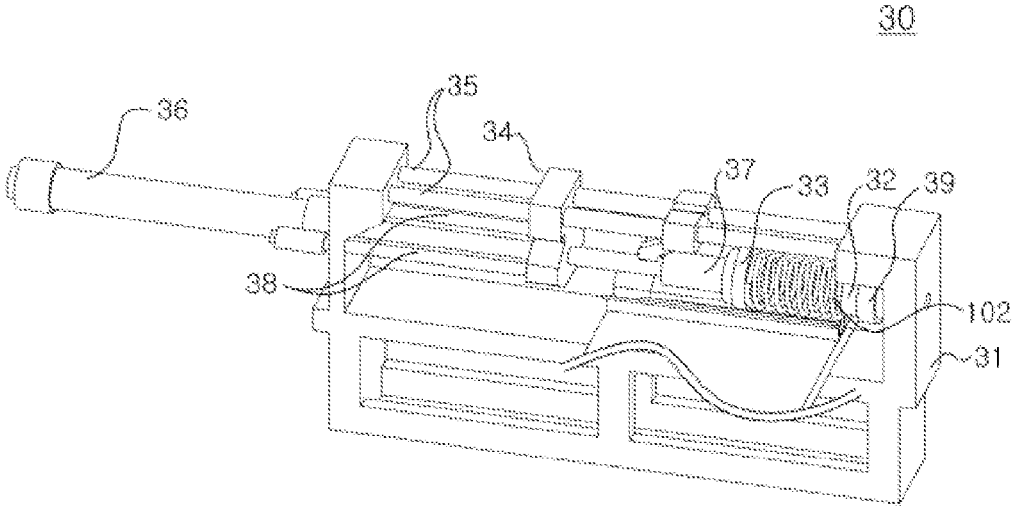
FIG. 9 is a perspective view illustrating driving of an inspection unit driving unit in an inspection unit of a marking system for springs according to an embodiment of the present invention.

The inspection apparatus 30 inspects a load of the spring 102. Referring to FIGS. 8 and 9, the inspection apparatus 30 includes an inspection unit base 31, a first inspection jig 32 connected to the inspection unit base 31 and adhered to one surface of the spring 102, a load cell 39 connected to the first inspection jig 32, for measuring a load value of the spring 102, a second inspection jig 33 located at a site facing the first inspection jig 32 and adhered to a surface opposite to the surface of the spring 102 attached to the first inspection jig 32, a second inspection jig connecting rod 37 to which the second inspection jig is fixed, an inspection unit driving unit 34 to which the second inspection jig connecting rod 37 is fixed, for moving the second inspection jig 33 forwards and rearwards, an inspection unit driving shaft 35 installed in the inspection unit base 32 and configured to act as a shaft while passing through the inspection unit driving unit 34, an inspection unit cylinder 36 for moving the inspection unit driving unit 34 forwards and rearwards, and an auxiliary inspection unit driving shaft 38 located on a side surface of the inspection unit cylinder 36, fixed to the inspection unit driving unit 34, and configured to pass through the inspection unit base 21. The setting unit driving unit 34 includes a first inspection unit driving member 34*a* in which the inspection unit cylinder 36 and the auxiliary inspection unit driving shaft 38 are connected to a rear surface thereof, an inspection unit driving member connecting rod 34*b* connected to a front surface of the first inspection unit driving member 34*a*, and a second inspection unit driving member 34*c* to which the inspection unit driving member connecting rod 34*b* is connected and through which the inspection unit driving shaft 35 passes.

A sequence of the operations of the inspection apparatus 30 according to an embodiment of the present invention is as follows. If the spring 102 on which the setting operation is completely performed is moved to the inspection apparatus 30 by the conveyor 50, the inspection unit driving unit 34 is moved towards the spring 102 by a preset distance, so that the spring 102 is compressed by the first inspection jig 32 and the second inspection jig 33, and then a load value of the spring 102 is measured using the load cell 30, and the measured value is delivered to the controller. After the spring 102 is measured, the inspection unit driving unit 34 is moved in a direction away from the spring 102, and the spring 102 is moved to the marking 30 using the conveyor 40. In an embodiment of the present invention, a load inspection has been exemplified as the inspection process, but an additional inspection or other inspections may be performed if necessary.

Figure 10:
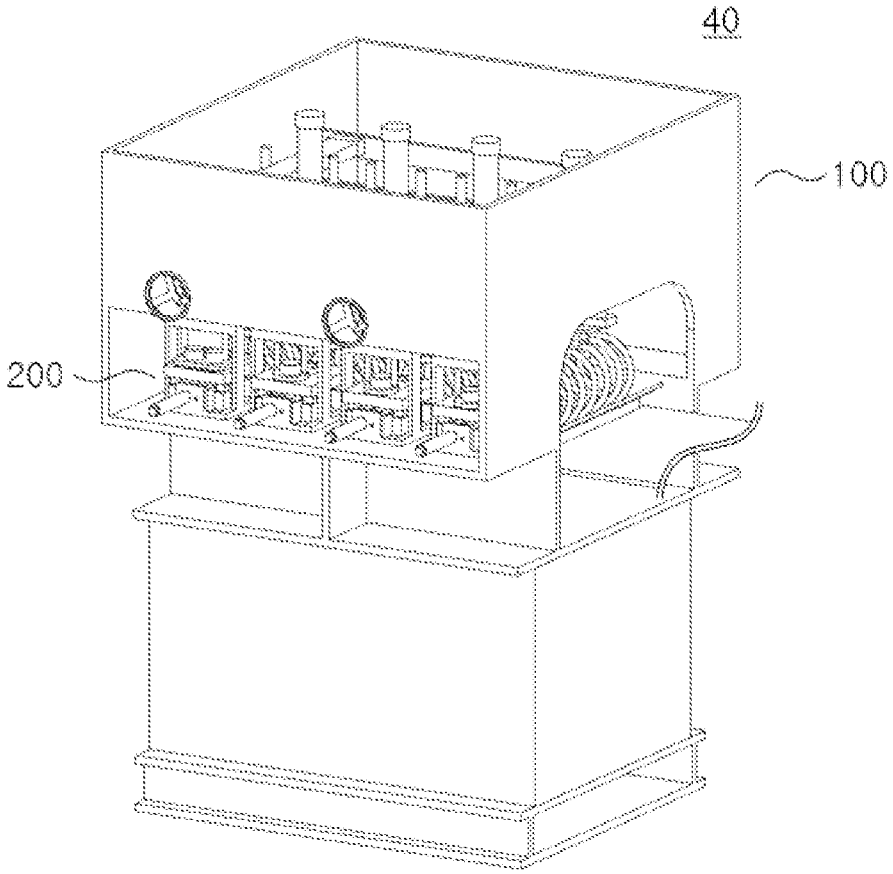
FIG. 10 is a perspective view illustrating a marking unit of a marking system for springs according to an embodiment of the present invention.
Figure 11:
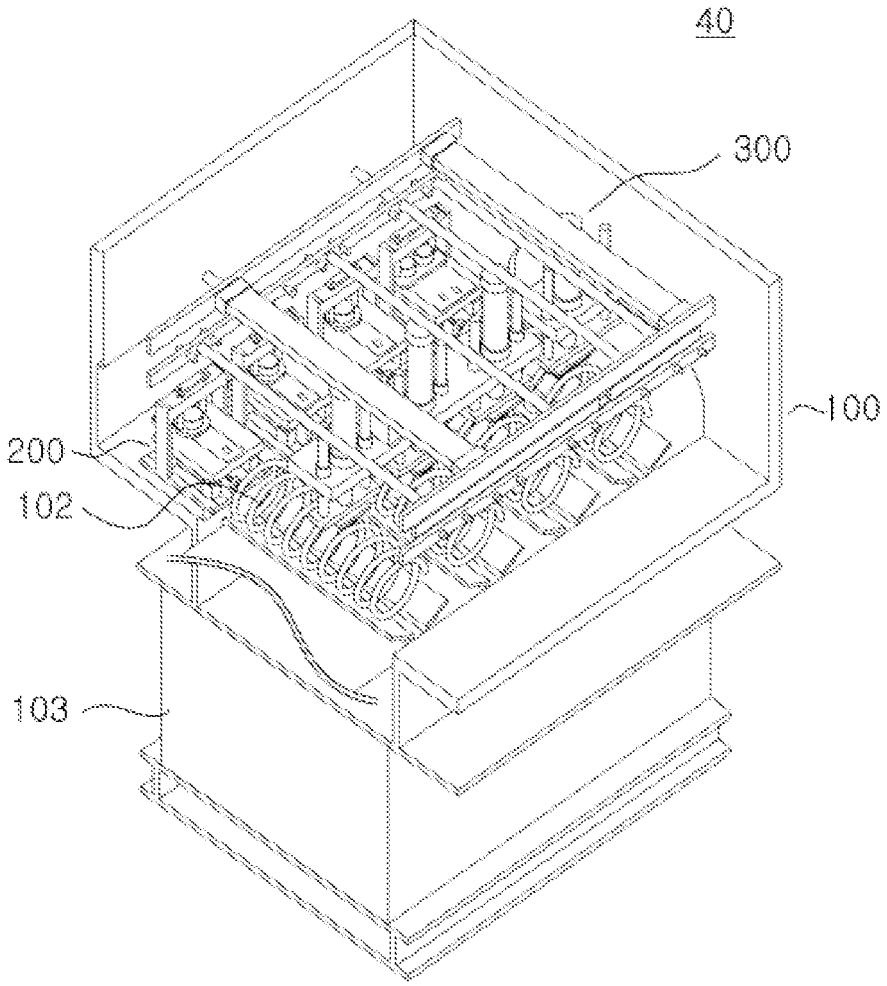
FIG. 11 is a sectional perspective view illustrating a marking unit of a marking system for springs according to an embodiment of the present invention.

Referring to FIGS. 10 and 11, the marking apparatus 40 includes a frame 100 having a space for marking therein, an ink unit 200 for preparing ink for marking, and a pad unit 300 for contacting the ink unit 200 such that the ink is stuck to the pad unit 300 to be applied on the spring 102.

The frame 100 has a space for marking therein and a lower side of the frame 100 corresponds to a support member 104, and the spring 102 is moved while the conveyor 50 passes through a side surface of the frame 100 and the ink unit 200 may be controlled through an opened space of a front surface of the frame 100.

Figure 12:
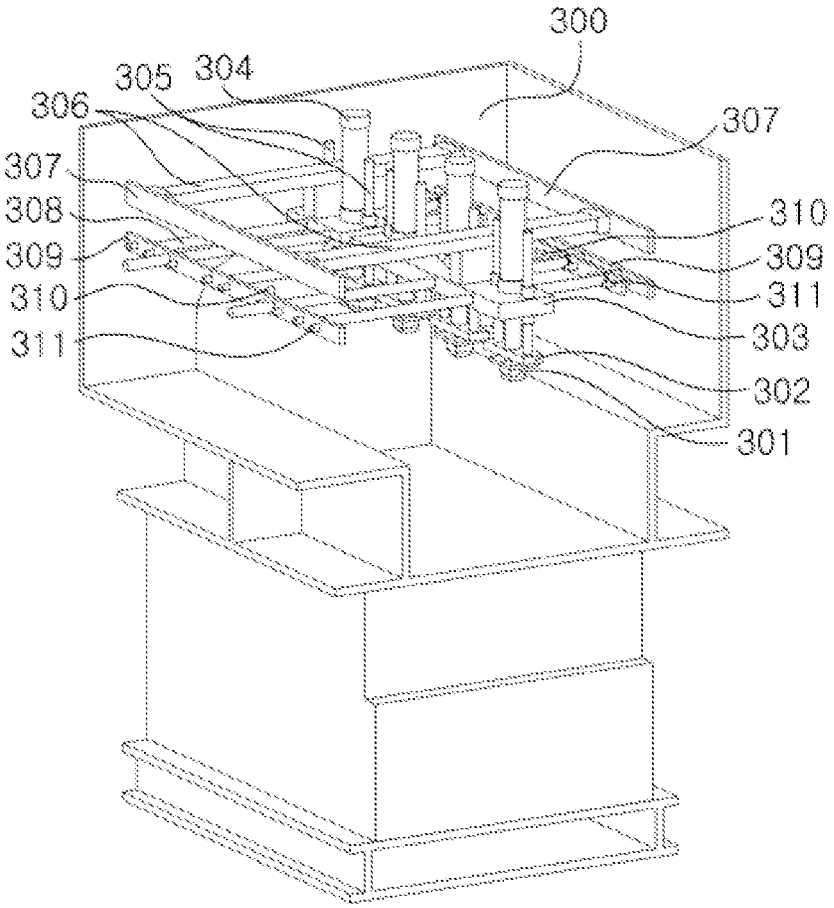
FIG. 12 is a perspective view illustrating pad unit in a marking unit of a marking system for springs according to an embodiment of the present invention.

Referring to FIG. 12, the pad unit 300 includes a pad 301 for applying the stuck ink on the spring 102, a pad unit cylinder 304 connected to the pad 301, for moving the pad 301 upwards and downwards, an auxiliary pad unit cylinder shaft 305 coupled to opposite side surfaces of the pad unit cylinder 304, a pad connecting unit 302 for connecting the auxiliary pad unit cylinder shaft 305 and the pad 301, a pad feeding unit 303 connecting a plurality of pad unit cylinders 304, for moving the pad 301 forwards and rearwards, a plurality of pad feeding unit shafts 308 for forming shafts with which the pad feeding unit 303 is moved, a rodless cylinder for moving the pad feeding unit 303 forwards and rearwards, a rodless cylinder fixing unit 307 for fixing the rodless cylinder to the frame 100, a pad feeding unit shaft fixing unit 309 for fixing the pad feeding unit shaft 308 to the frame 100, a plurality of pad feeding unit stopper 311 for restricting a movement distance of the pad feeding unit 303, and a sensor 310 for restricting and detecting a distance of the pad feeding unit 303. The pad unit 300 is configured such that the pad 301 is moved upwards and downwards to stick ink to the pad 301, and the pad 301 may be moved forwards and rearwards for marking by moving the pad 301 to which ink is stuck towards a side surface of the spring 102.

Referring to FIG. 20, the ink unit 200 includes an ink unit base 201, a marking plate feeding unit 202 coupled to the ink unit base 201 and configured to move forwards and rearwards, a marking plate 205 mounted to the marking plate feeding unit 202 and having a corrosion processing part 206 corroded to have a shape that will be marked, an ink cup 204 for preserving ink therein, for sticking ink to the corrosion processing part 206 of the marking plate 205, and an ink cup fixing unit 208 for fixing the ink cup 204. The marking plate 205 is positioned on an upper end surface of the marking plate feeding unit 202, and an ink unit cylinder 203 for moving the marking plate feeding unit 202 forwards and rearwards and a marking plate feeding unit stopper 209 for restricting a movement distance of the marking plate feeding unit 202 are formed on a lower surface of the marking plate feeding unit 202. An ink unit cylinder fixing unit 211 for fixing the ink unit cylinder 203 of the marking plate feeding unit 202 and an ink unit base stopper 210 for restricting a movement distance of the marking plate feeding unit 202 are formed on a lower surface of the ink unit base 201, and movement of the marking plate feeding unit 202 is stopped when the ink unit base stopper 210 contacts the marking plate feeding unit stopper 209. An ink cup fixing unit 207 for fixing the ink cup 204 is coupled to an upper side of the ink unit base 201, and an ink cup fixing rod 208 of the ink cup fixing unit 207 coupled to the ink unit base 201 presses the ink cup to fix the ink cup. In an embodiment of the present invention, the marking apparatus including four marking units 40 is exemplified, and different colors of ink are contained in the ink cups 204 of the marking units 40 so that the springs are marked with different colors according to the characteristics of the springs 102. In the embodiment of the present invention, five marking units 30 are exemplified but the number of the marking units may be smaller than or larger than five.

Figure 13:
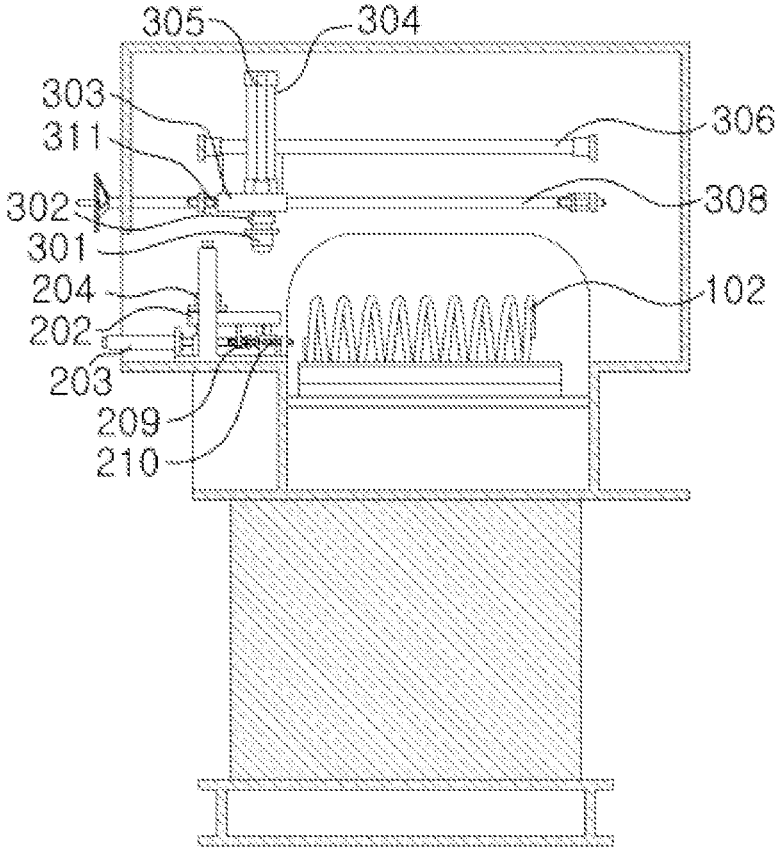
FIG. 13 is a side sectional view illustrating an appearance before driving of a marking unit of a marking system for springs according to an embodiment of the present invention.
Figure 14:
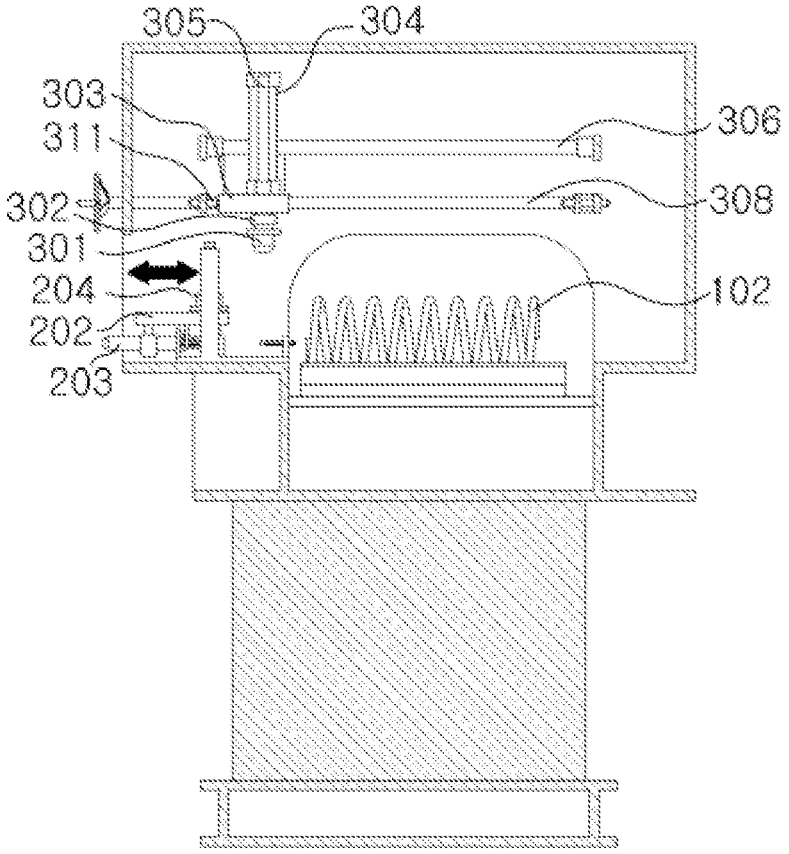
FIG. 14 is a side sectional view illustrating driving of an ink unit in a marking unit of a marking system for springs according to an embodiment of the present invention.
Figure 15:
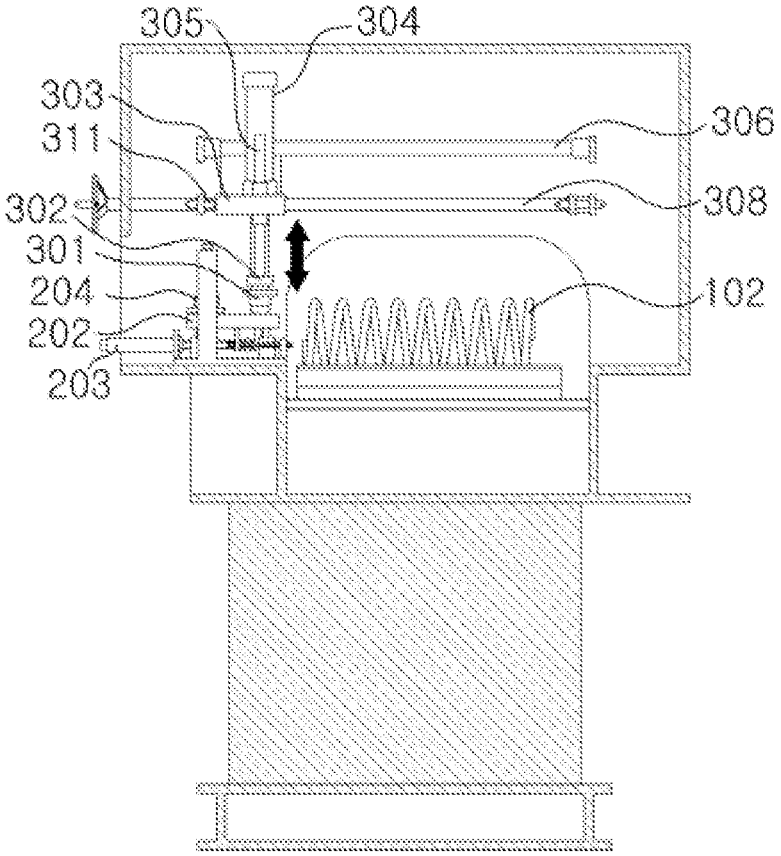
FIG. 15 is a side sectional view illustrating upward and downward driving of a pad unit in a marking unit of a marking system for springs according to an embodiment of the present invention.
Figure 16:
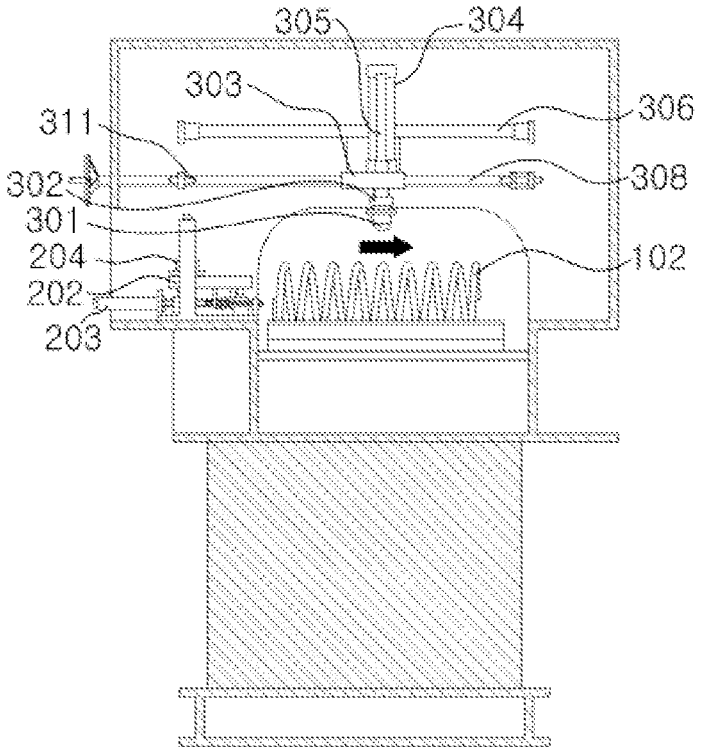
FIG. 16 is a side sectional view illustrating forward and rearward driving of a pad unit in a marking unit of a marking system for springs according to an embodiment of the present invention.
Figure 17:
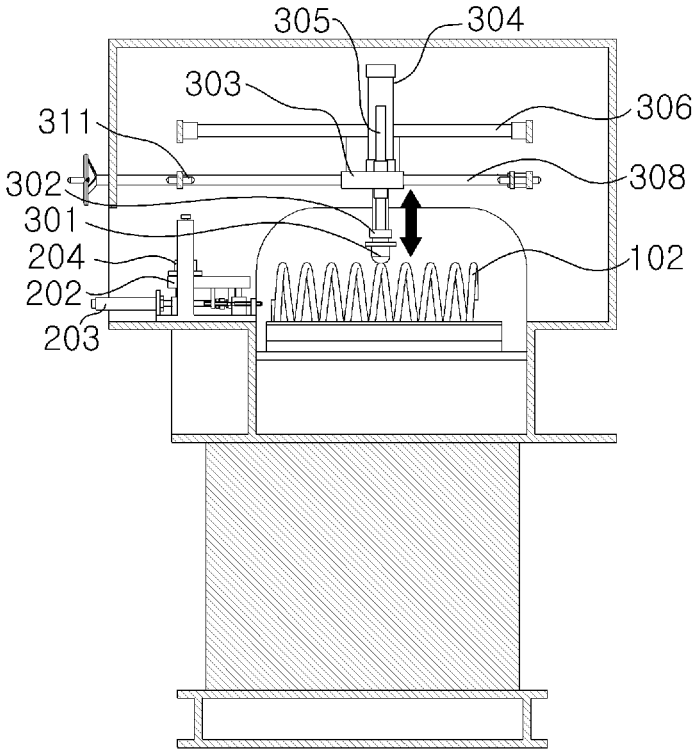
FIG. 17 is a side sectional view illustrating upward and downward driving of a pad unit for marking of a side surface of a spring in a marking unit of a marking system for springs according to an embodiment of the present invention.
Figure 18:
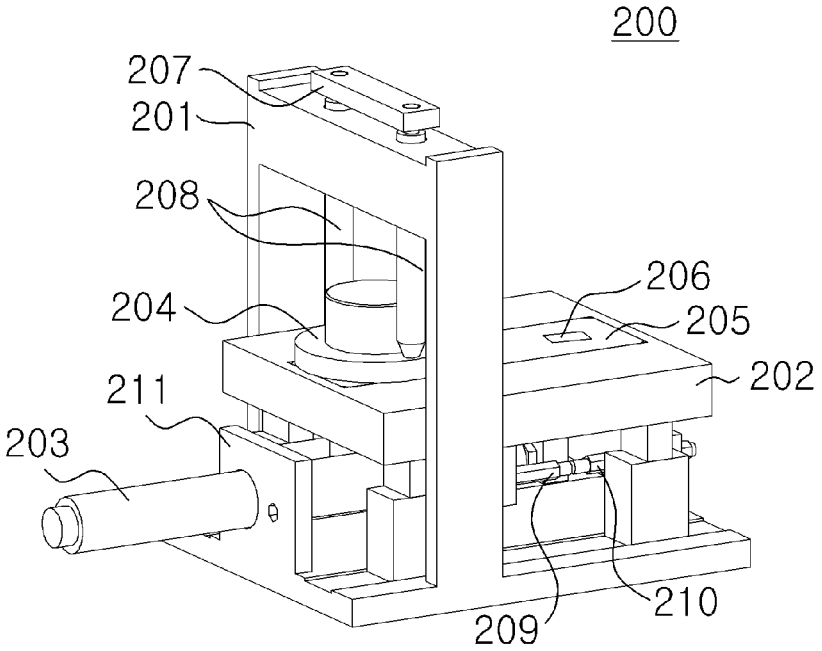
FIG. 18 is a perspective view illustrating an ink unit in a marking unit of a marking system for springs according to an embodiment of the present invention.

A sequence of the operations of the marking apparatus 30 for springs according to an embodiment of the present invention is as follows. As illustrated in FIG. 13, the spring 102 on which a load inspection is completely performed by the inspection apparatus 30 is moved to the marking apparatus 40 by the conveyor 50, and after the ink unit 200 moves the marking plate feeding unit 202 rearwards as illustrated in FIG. 14 such the corrosion processing part 206 of that the marking plate 205 is located on a lower side of the ink cup 204, the marking plate feeding unit 202 is moved forwards again such that the ink contained in the ink cup 204 is stuck to the corrosion processing part 206 of the marking plate 205. Thereafter, as illustrated in FIG. 15, after the ink of the corrosion processing part 206 is stuck to the pad 301 by moving the pad 301 located on an upper side of the corrosion processing unit 206 of the marking plate 205 downwards, the pad 301 is moved upwards again, and as illustrated in FIG. 16, the pad is moved forwards such that the pad 301 to which the ink is stuck is located on an upper side of a side surface of the spring 102. Thereafter, as illustrated in FIG. 17, after the pad 301 is brought into contact with a side surface of the spring 102 by moving the pad 301 downwards towards a side surface of the spring such that the ink stuck to the pad 301 is applied on a side surface of the spring 102, the pad is moved upwards again and is moved rearwards to face the ink unit 200 to be located to an initial position. Five ink units 200 and five pad units 300 are exemplified in the marking apparatus 30 according to the embodiment of the present invention, and different colors of ink are preserved in the ink cups 204 of the ink units 200. Although all the springs 102 are located in front of the five ink units 200 in the marking apparatus 40 because they are moved in units of one section by the conveyor, a marking operation is performed only when the springs are located in the ink unit 200 in which the different colors of ink according to the load values measured by the inspection apparatus 30 are preserved using a signal delivered from the controller, instead of performing a marking operation by all the ink units 200.

The marking system for springs according to the present invention is not limited to the aforementioned embodiment, but may be variously modified without departing from the scope of the present invention which is defined in the claims.

What is claimed is:

1. A marking system for springs comprising:

a conveyor;

an arranging apparatus for arranging a spring fed to the arranging apparatus by the conveyor, wherein the arranging apparatus comprises: an arranging unit base; a first arranging jig fixed to the arranging unit base to contact one surface of the spring; a second arranging jig located at a site facing the first fixing jig and contacting an surface opposite to the surface of the spring that contacts the first arranging jig; a rotary motor connected to the second arranging jig, for rotating the second arranging jig; an arranging unit moving unit to which the second arranging jig is fixed and configured to move forwards and rearwards towards the spring; an arranging unit moving shaft passing through the arranging unit moving unit; and an arranging unit cylinder connected to the arranging unit moving unit, for moving the arranging unit moving unit forwards and rearwards; and a marking apparatus for applying an identification mark on the arranged spring fed to the marking apparatus by the conveyor, wherein the marking apparatus comprises:

a frame having a space for marking therein;

a pad unit for applying a mark on the arranged spring located in the frame; and an ink unit for supplying ink to the pad unit.

2. The marking system of claim 1, wherein the pad unit comprises:

a pad for applying a mark on the arranged spring;

a pad feeding unit to which the pad is connected, for moving the pad upwards and downwards, and forwards and rearwards;

a pad unit cylinder to which the pad is connected, for providing power for moving the pad upwards and downwards; and a rodless cylinder connected to the pad feeding unit, for providing power for moving the pad forwards and rearwards.

3. The marking system of claim 1, wherein the ink unit comprises:

an ink cup base;

an ink cup for supplying ink;

a marking plate to which the ink contained in the ink cup is stuck;

a marking plate feeding unit for positioning the marking plate and moving the marking plate forwards and rearwards on a lower side of the ink cup; and a marking unit cylinder for providing power for moving the marking plate feeding unit forwards and rearwards.

4. The marking system of claim 1, wherein an escape part contacting an end of the spring where the rotation of the spring is completely ended is formed in the second arranging jig, and the spring is rotated by bringing the escape part and the end of the spring into contact with each other through rotation of the second arranging jig.

5. The marking system of claim 1, wherein a protrusion contacting a start part of the spring where the spring starts to be rotated is formed in the first arranging jig, and a location of the spring is arranged by bringing the protrusion and the start part of the spring into contact with each other through rotation of the spring.

* * * * *